US008572920B2

(12) United States Patent
Bailey et al.

(10) Patent No.: US 8,572,920 B2
(45) Date of Patent: Nov. 5, 2013

(54) SELF-CENTERING CEILING PANEL

(75) Inventors: David Bailey, Alpharetta, GA (US); Ko Kuperus, Superior, CO (US); Richard Mayer, Brighton, CO (US)

(73) Assignee: Hunter Douglas Inc., Pearl River, NY (US)

( * ) Notice: Subject to any disclaimer, the term of this patent is extended or adjusted under 35 U.S.C. 154(b) by 112 days.

(21) Appl. No.: 13/082,159

(22) Filed: Apr. 7, 2011

(65) Prior Publication Data

US 2011/0252736 A1 Oct. 20, 2011

Related U.S. Application Data

(60) Provisional application No. 61/325,066, filed on Apr. 16, 2010.

(51) Int. Cl.
*E04B 2/00* (2006.01)

(52) U.S. Cl.
USPC ..... 52/506.07; 52/506.08

(58) Field of Classification Search
USPC ..... 52/483.1, 489.1, 506.06–506.1
See application file for complete search history.

(56) References Cited

U.S. PATENT DOCUMENTS

| | | | | |
|---|---|---|---|---|
| 4,463,537 | A * | 8/1984 | Rodriquez et al. | 52/506.07 |
| 4,736,564 | A * | 4/1988 | Gailey | 52/506.07 |
| 5,311,719 | A * | 5/1994 | Jahn | 52/506.09 |
| 5,417,025 | A | 5/1995 | Nute et al. | |
| 2008/0086962 | A1 * | 4/2008 | Jahn et al. | 52/220.6 |

FOREIGN PATENT DOCUMENTS

| | | | |
|---|---|---|---|
| DE | 29802291 | U1 | 6/1998 |
| DE | 202004013228 | U1 | 11/2004 |
| EP | 1898016 | A2 | 3/2008 |

* cited by examiner

*Primary Examiner* — William Gilbert
(74) *Attorney, Agent, or Firm* — Dorsey & Whitney LLP

(57) ABSTRACT

A panel for a drop ceiling is made of a semi-rigid but resilient material such as spring steel and includes corner clips adapted to cooperate with the inverted T-shaped stringers of a drop ceiling support system so that the panel is self-centering between opposing stringers and is spring biased into a clamped relationship with horizontal flanges of the inverted T-shape stringers to prevent the panel from moving up and down. The corner clips are also designed to transfer any horizontal compressive shear force in the mounting system to vertical edges of the panel so as not to undesirably bow the flat base of the panel.

20 Claims, 8 Drawing Sheets

SELF-CENTERING CEILING PANEL

CROSS REFERENCE TO RELATED APPLICATION

This application claims priority to U.S. provisional application No. 61/325,066, entitled "Self-Centering Ceiling Panel" filed on Apr. 16, 2010, which is hereby incorporated herein by reference in its entirety.

BACKGROUND OF THE INVENTION

1. Field of the Invention

The present invention relates generally to drop ceiling systems and more particularly to a ceiling panel that can be inserted into and supported by a gridwork suspended from a ceiling. The panel is made from a semi-rigid and resilient material having each side edge of the panel folded upwardly to define horizontal and vertical edges which receive removable clips in each corner of the panel that are in turn adapted to be releasably connected to the suspended gridwork of the ceiling system. The clips are designed so that each panel will be self-centered within an opening in the supporting gridwork and are snapped into the opening in a manner so as not to place compressive shear forces on the base of the panel.

2. Description of the Relevant Art

Drop ceilings for building structures have been common for many years and are suitable to be suspended from an existing ceiling so that a new, lowered ceiling structure is positioned beneath the existing ceiling and can assume numerous patterns with various types of ceiling panels. Typically, the drop ceilings have a suspended gridwork defining quadrangular openings which may be square or rectangular depending upon the aesthetics desired for the room in which the drop ceiling is installed. The gridwork defining the openings typically includes perpendicular stringers having horizontal flanges or shoulders on which the ceiling panels can rest under the influence of gravity. Panels can be removed by pushing upwardly along one edge and tilting the panel so that it will drop through the quadrangular opening and can thereby be replaced if desired.

Most drop ceiling panels are made of an acoustic tile which have certain desirable characteristics as far as aesthetics and sound absorption is concerned, but such panels are inflexible and it is very difficult to insert a panel into an opening in the gridwork so it can rest on the stringers defining the grid system in a uniform manner. Many times such acoustical panels will break during installation or become discolored or water stained thereby necessitating replacement of the ceiling panel and, accordingly, there is considerable waste and frequent replacement of acoustical panels in a drop ceiling.

In lieu of acoustical panels, metal panels can also be used to obtain a different aesthetic with metal panels solving some of the problems with acoustical panels. Metal panels, however, typically have spring clips along the side edges thereof which are biased outwardly into engagement with the stringers in the supporting gridwork, and while the springs are helpful in holding the panel in the desired position within the gridwork, they typically place the panel under shear compression so that over time the panel may undesirably bow disrupting the aesthetic continuity of the drop ceiling. It is to overcome the shortcomings in prior art drop ceilings that the present invention has been made.

SUMMARY OF THE INVENTION

The ceiling panel of the present invention is designed to be supported in a conventional drop ceiling supporting gridwork wherein perpendicular stringers forming the gridwork define quadrangular openings in which the panel of the present invention can be supported. The stringers have a vertical web along their length with oppositely directed horizontal shoulders or shelves projecting into adjacent openings and on which the ceiling panel of the present invention is supported.

The ceiling panel itself is made of steel or aluminum but includes clips made of a semi-rigid but resilient material such as spring steel so the panel is positionable within an opening in the gridwork so as to be self-centered within the opening and also in a manner so that it does not easily change positions within its opening and is not subjected to compressive shear forces which might distort or bow the panel over time.

Each panel is of a predetermined quadrangular configuration which might be square or rectangular depending upon the aesthetics desired for the ceiling. Each panel, therefore, has four mutually perpendicular side edges, and the panel is folded along the side edges to define a horizontal flange and a vertical flange to which releasable clips can be attached in each corner of the panel. The clips themselves are designed to cooperate with the stringers in the supporting gridwork of a drop ceiling to support the panel in a spring biased manner within an opening defined in the gridwork so that the panel will self center within the opening and will be held positively against the supporting flanges of the stringers around the opening in which the panel is positioned.

Other aspects, features and details of the present invention can be more completely understood by reference to the following detailed description of a preferred embodiment, taken in conjunction with the drawings and from the appended claims.

DETAILED DESCRIPTION OF THE INVENTION

Figure 1:
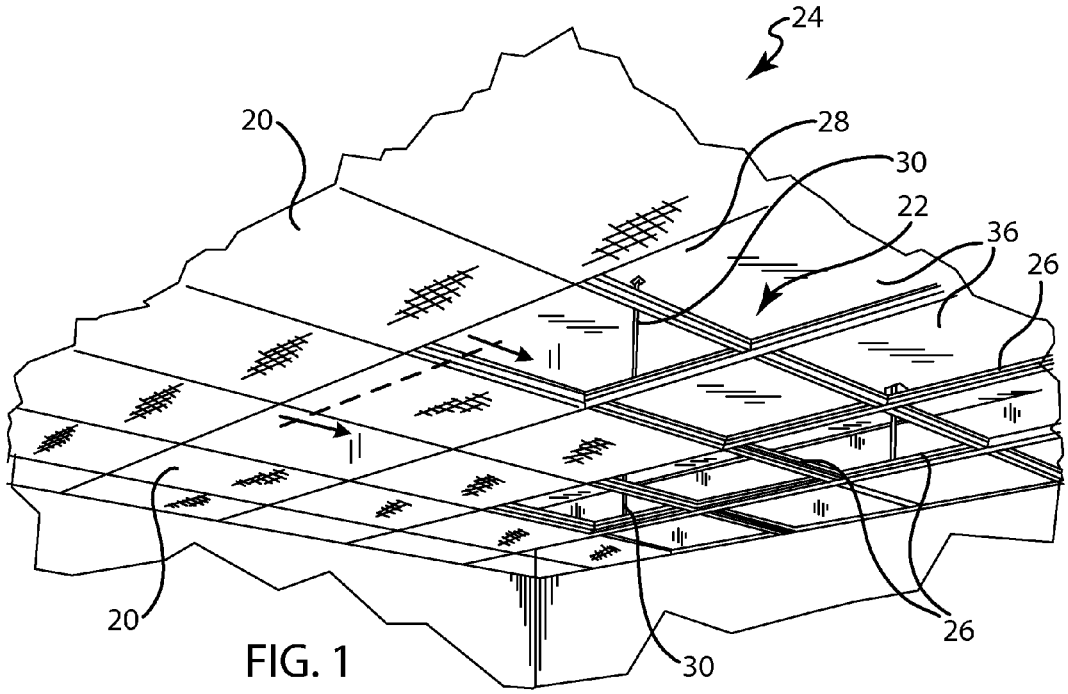
FIG. 1 is a fragmentary isometric looking upwardly in the corner of a room of a building structure in which a ceiling panel system incorporating ceiling panels of the present invention are supported in some of the openings defined by a suspended gridwork.
Figure 2:
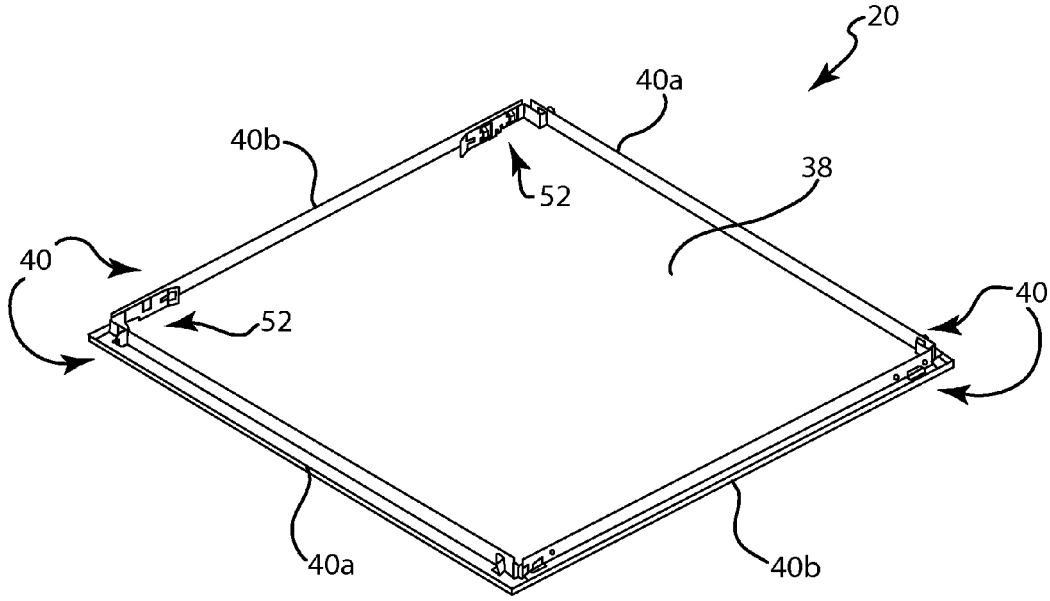
FIG. 2 is an isometric looking downwardly on a ceiling panel in accordance with the present invention showing corners of the panel at the top, bottom, left and right.
Figure 3:
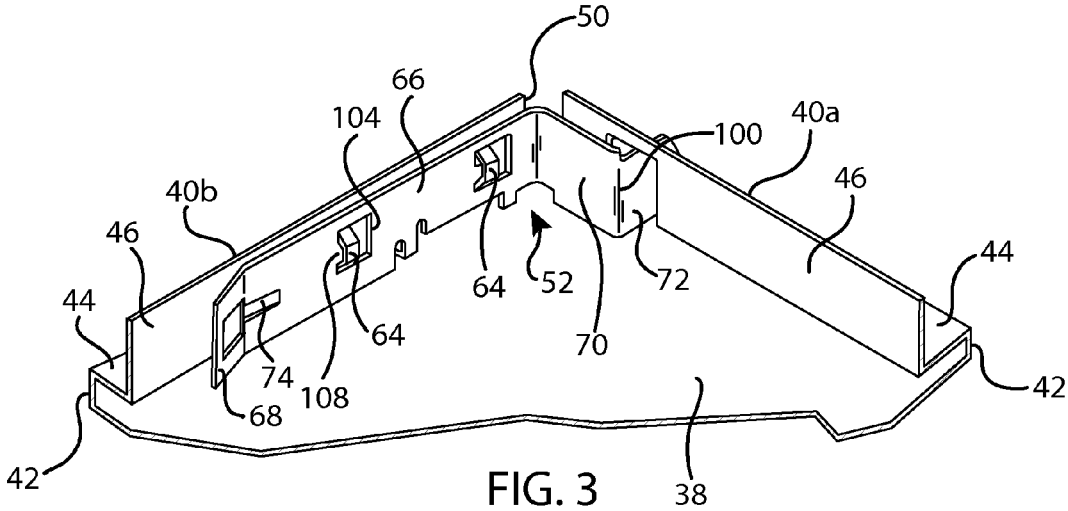
FIG. 3 is an enlarged fragmentary isometric looking downwardly at the top corner of the panel as shown in FIG. 2.
Figure 4:
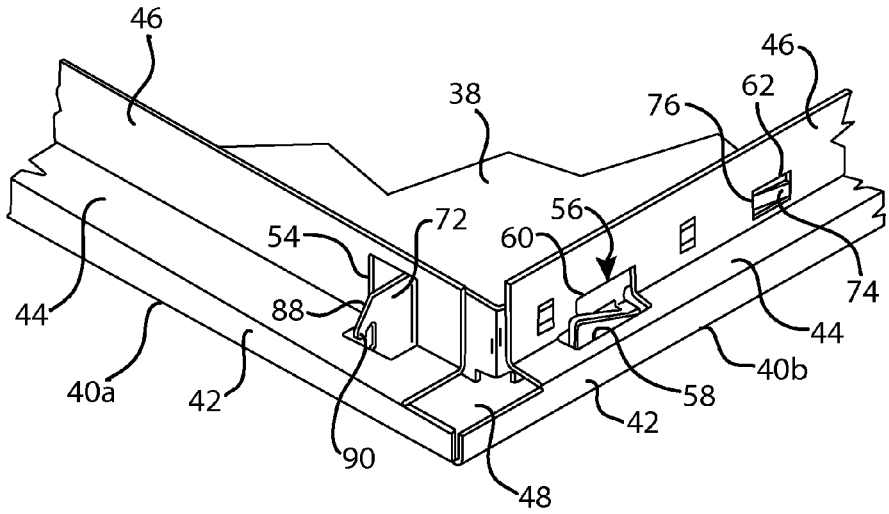
FIG. 4 is a fragmentary isometric looking downwardly at the bottom corner of the panel of FIG. 2.
Figure 6:
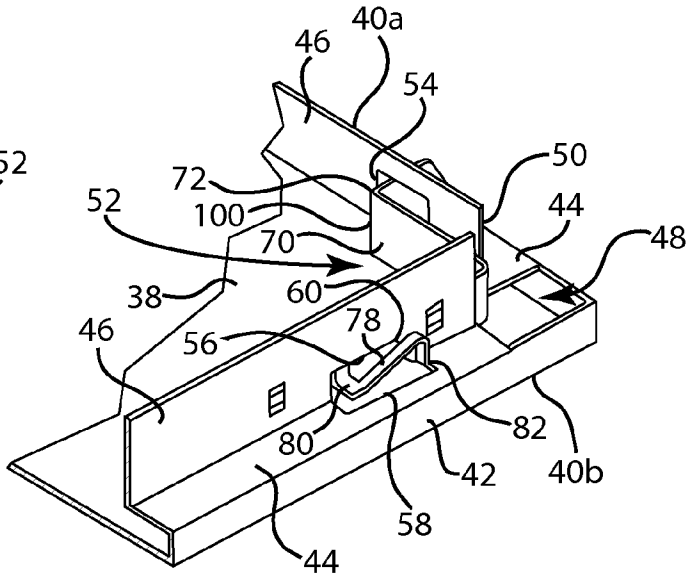
FIG. 6 is a fragmentary isometric looking downwardly at the right corner of the panel of FIG. 2.
Figure 5:
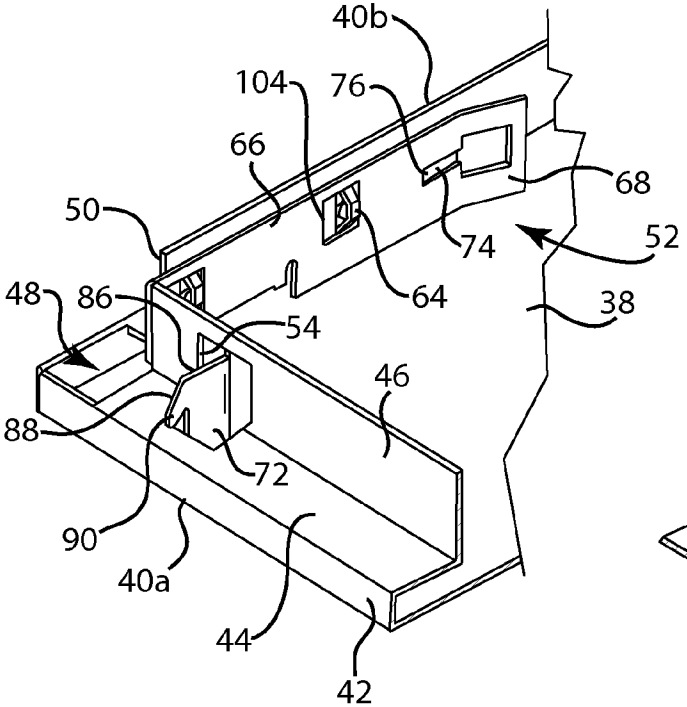
FIG. 5 is a fragmentary isometric looking downwardly at the left corner of the panel of FIG. 2.

The ceiling panel 20 of the present invention is designed to be used in a conventional suspended gridwork 22 of a drop ceiling system 24 of the type seen best in FIG. 1. It can there be appreciated that a plurality of mutually perpendicular stringers 26 are suspended from an overhead ceiling 28 with suspension rods 30 so that a gridwork of such stringers is defined in a horizontal plane. Each stringer is of inverted T-shaped cross-section as can be seen best in FIGS. 11-16 having a vertical web 32 connected to the suspension rods and flanges or shoulders 34 projecting in opposite directions from the vertical web along its lowermost edge. The shoulders are adapted to support a ceiling panel 20 in a manner such that when looking upwardly at the drop ceiling, an observer sees the panels in closely spaced and aligned relationship with the stringers substantially blocked from vision. Quadrangular openings 36 defined by the stringers can be square or rectangular depending upon the desired aesthetics, but for purposes of the present disclosure, the openings are seen to be square and the ceiling panels also are of square configuration and of a size to be supported on the shoulders defining an opening in the gridwork.

The ceiling panels 20 themselves are probably best appreciated by reference to FIGS. 2-10. They can there be seen to include a flat square base 38 having four opposing side edges 40 which have been bent or otherwise formed to define a vertical wall 42, which could be inclined if desired for aesthetics, projecting upwardly from the flat square base of the panel, a horizontal flange 44 projecting inwardly and perpendicularly from the side wall, and a vertical flange 46 projecting upwardly from the innermost edge of the horizontal flange. The panels are made of a semi-rigid or rigid material such as steel or aluminum so that the panels will retain their preformed shape.

Each corner of the panel is best seen in FIGS. 7-10 as having an opening 48 defined in the plane of the horizontal flanges 44 at spaced ends of the flanges. The vertical flanges 46 are spaced slightly as well to define a vertical slot 50 between the ends of the vertical flanges at each corner. It should be appreciated that each corner of the panel is identical and, of course, formed where the side walls 42 of the panel meet perpendicularly and the adjacent ends of the horizontal and vertical flanges are spaced as mentioned above. While the four side edges of the panel are formed so as to have the side wall and the horizontal and vertical flanges, the horizontal and vertical flanges are treated in pairs so that opposing side edges 40*a*, which might be referred to as the first side edges, are identical while the side edges 40*b* which are perpendicular to the first side edges 40*a* and are referred to as the second side edges, are different from the first side edges but identical to each other. This is possibly best appreciated by reference to FIGS. 7-10, which show the ends of the first and second side edges in each of the four corners of the panel with an identical clip element 52 separated therefrom. The clips will be described in more detail hereafter and, of course, are integrated into the four corners of the panel as seen in FIGS. 3-6.

For convenience in describing the panel 20, the first opposing side edges 40*a* are those seen in FIGS. 7-10 sloping downwardly from left to right while the second opposing side edges 40*b* are those sloping upwardly from left to right.

Looking first at the first opposing side edges 40*a*, they can each be seen to include adjacent to each end thereof a continuous L-shaped slot 54 formed along the fold between the horizontal flange 44 and the vertical flange 46 with the slot having a vertical height in the vertical flange approximately twice that of the depth in the horizontal flange. The L-shaped slots can be seen spaced a short distance from the adjacent ends of the horizontal and vertical flanges.

Looking at the ends of the second opposing side edges 40*b* of the panel 20 in FIGS. 7-10, it will be appreciated there are L-shaped slots 56 that are continuous through the fold between the horizontal 44 and vertical 46 flanges so as to have a portion 58 of the slot in the horizontal flange and a portion 60 of the slot in the vertical flange. The portion of the slot in the horizontal flange is slightly longer than the portion in the vertical flange for a purpose that will become more apparent later. The L-shaped slots 56 are spaced a small distance from an associated end of the second opposing side edges 40*b* of the panel. Spaced toward the middle of the second opposing edges of the panel from the L-shaped slots 56 is a rectangular hole 62 formed in the vertical flange. This hole has its longitudinal dimension disposed horizontally. Straddling the L-shaped hole 56 in the second opposing side edges of the panel are a pair of punch-out trapezoidal fingers 64 which protrude inwardly of the vertical flange in which they are formed. The slots, holes, and fingers are all designed to cooperate with corresponding elements in the generally L-shaped clip 52 which fits into each corner of the panel along the inner faces of the vertical flanges.

The generally L-shaped clips 52, as probably seen best in FIGS. 7-10 and as previously mentioned, have a long leg 66 with an acutely bent free end 68 and a short leg 70 forming a perpendicular angle to the opposite end of the long leg. The short leg has a plate or spring-loaded hook finger 72 projecting perpendicularly therefrom in a direction away from the bent free end of the long leg. The clips in opposing corners of the panel are identical and mirror images of the clips in the other opposing corners.

Figure 8:
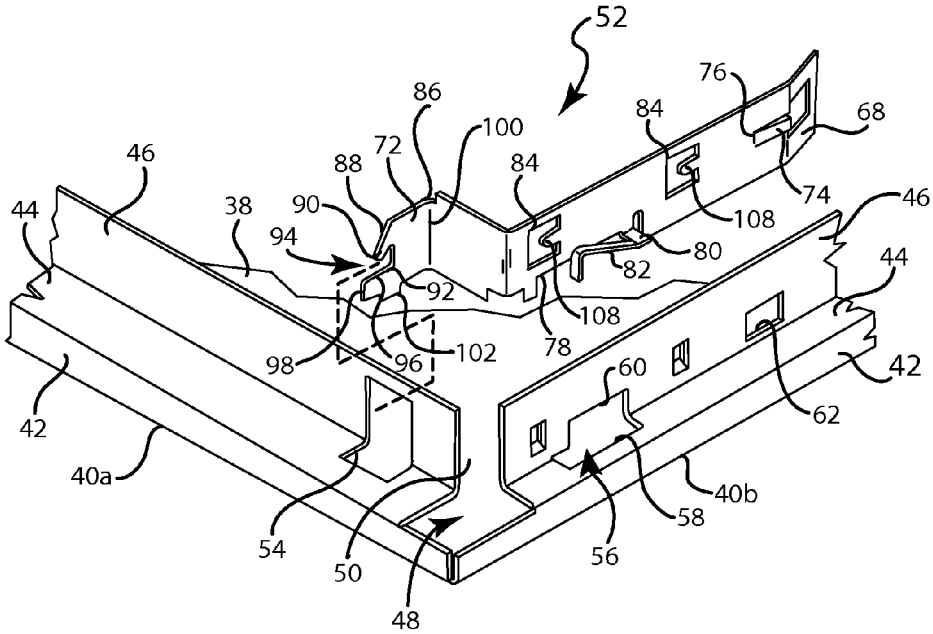
FIG. 8 is an exploded isometric looking at the corner of FIG. 4.
Figure 10:
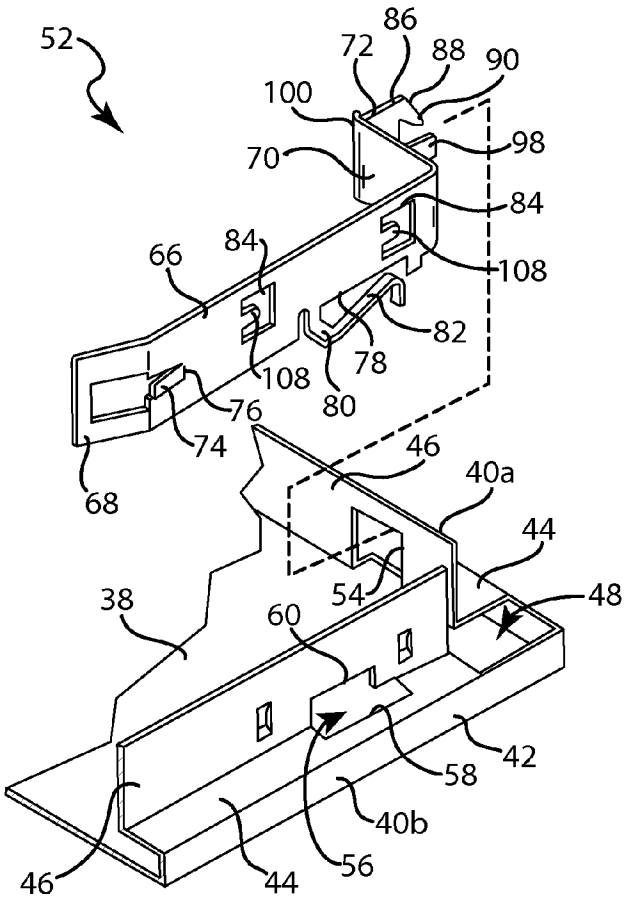
FIG. 10 is an exploded isometric looking at the corner of FIG. 6.
Figure 9:
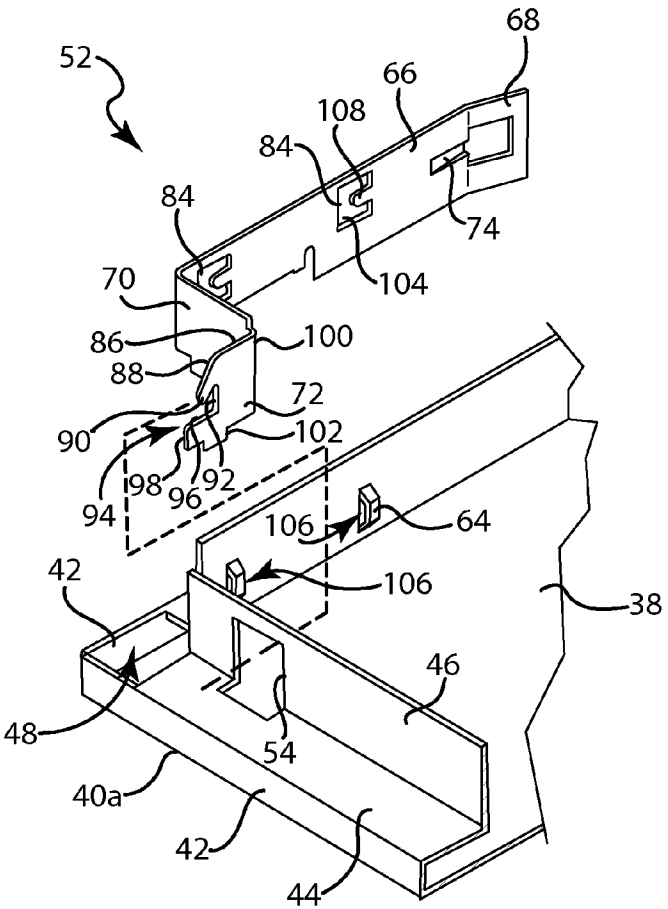
FIG. 9 is an exploded isometric looking at the corner of FIG. 5.
Figure 11:
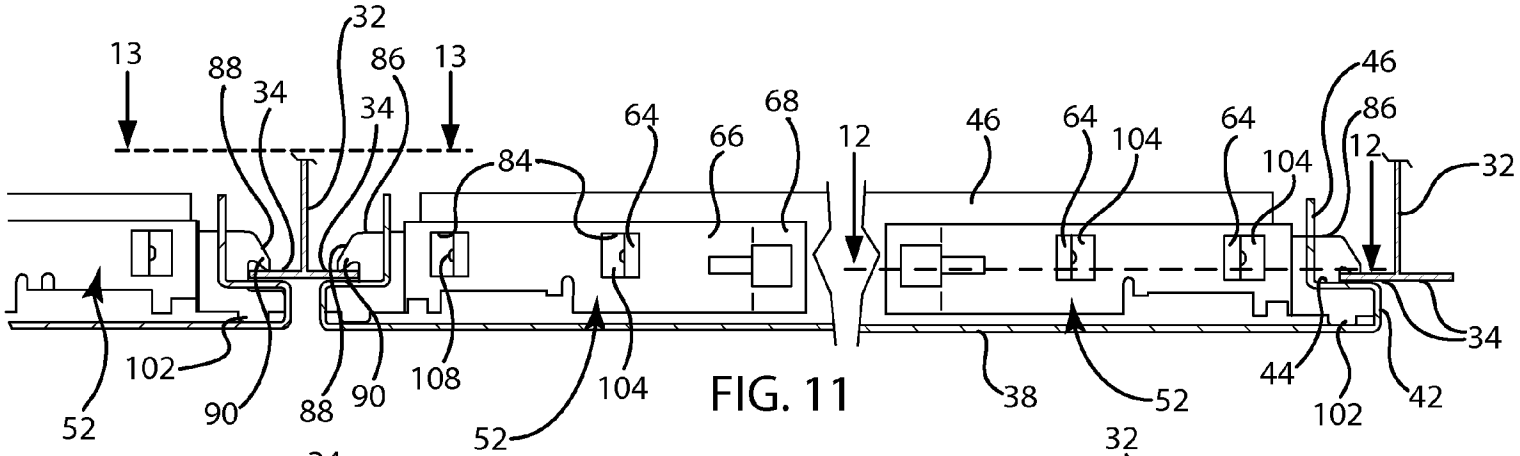
FIG. 11 is an enlarged fragmentary section taken along line 11-11 of FIG. 1.
Figure 12:
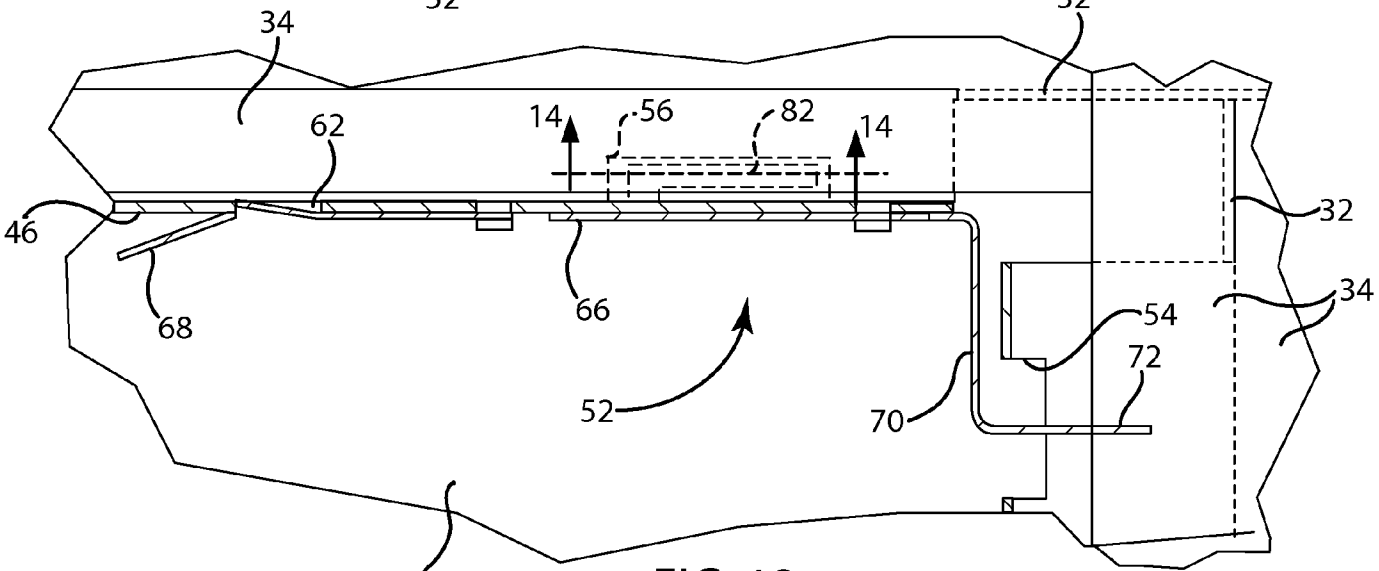
FIG. 12 is an enlarged section taken along line 12-12 of FIG. 11.
Figure 13:
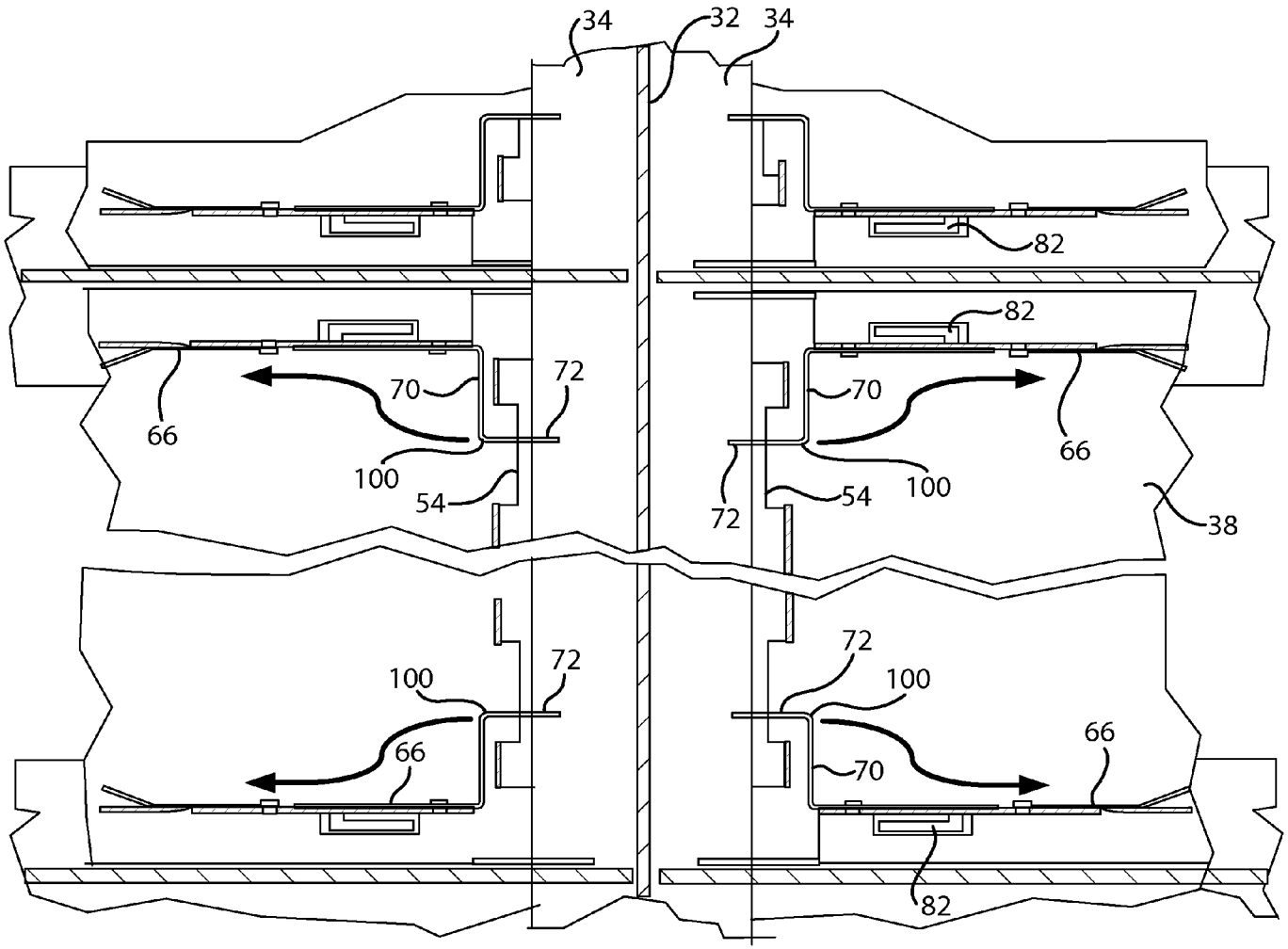
FIG. 13 is an enlarged view taken along line 13-13 of FIG. 11.
Figure 14:
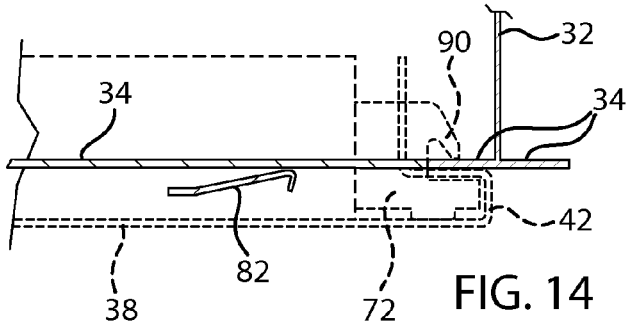
FIG. 14 is an enlarged section taken along line 14-14 of FIG. 12.

At the acute bend 74 in the long leg 66, a lock finger 74 is formed so as to extend horizontally and protrude slightly and laterally outwardly of the long leg. The lock finger resiliently pivots about a fold 76 at the end of the lock finger most distant from the free end 68 of the long leg of the clip. Adjacent the opposite end of the long leg, a notch 78 is formed in the bottom of the leg and a horizontal tab 80 projects outwardly laterally away from the long leg and integrally supports one end of a generally J-shaped spring arm 82 which tapers upwardly and toward the end of the clip 52 having the short leg 70 before turning vertically downwardly. The spring arm in its neutral position is as illustrated in FIGS. 8 and 10, but can be depressed downwardly for a purpose to be described hereafter thereby defining an upward bias. Spaced longitudinally in opposite directions from the notch 78 in the lower edge of the long leg, a pair of U-shaped holes 84 is formed through the long leg with the U-shaped holes lying on their side so as to open toward the acutely bent free end 68 of the long leg.

Figure 7:
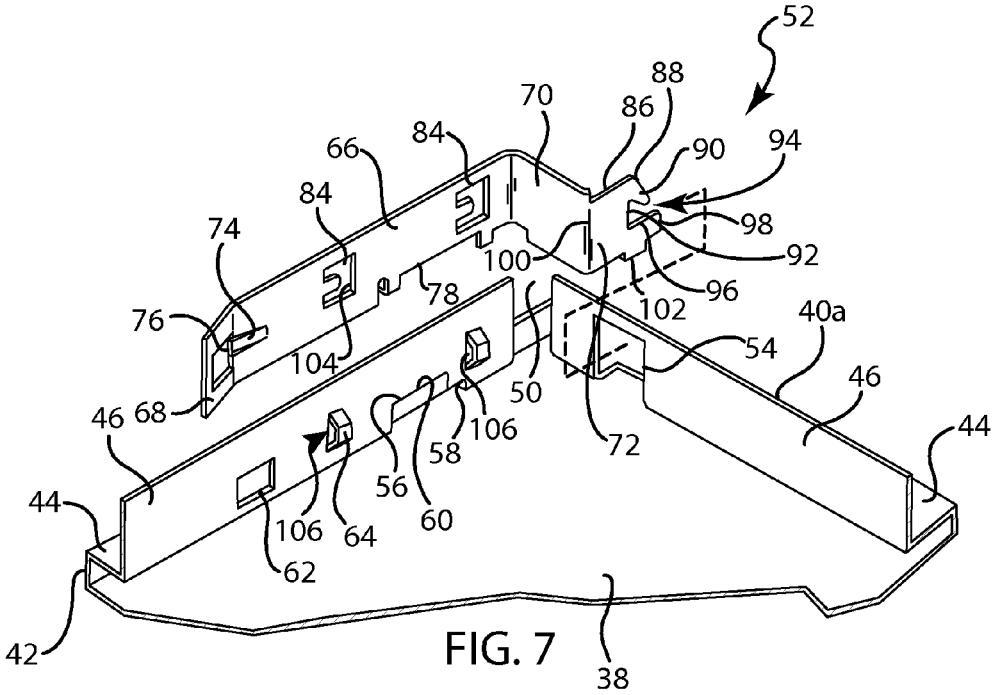
FIG. 7 is an exploded isometric looking at the corner of FIG. 3.

As probably best seen in FIG. 7, the perpendicularly bent plate 72 at the free end of the short leg 70 has a flat upper edge 86 with its distal end tapered downwardly to define a cam surface 88 and at the lower end of the cam surface a latch finger 90 that is continuous with a vertical edge 92 in the plate forming the innermost extent of a notch 94 defined in the plate. The vertical edge 92 has its lower end continuous with a perpendicular horizontal edge 96 defining an opposite or lower side of the notch. At the free end of the horizontal edge, a rear edge 98 of the plate extends downwardly and then horizontally back to the bend 100 at the free end of the short leg of the clip. An abutment tab 102 is formed along the lower edge of the plate for a purpose to become clearer hereafter.

It should be noted the clip 52 is made of a semi-rigid resilient material, such as spring steel. This characteristic of the material allows a clip to be snapped into each corner of the panel so as to be connected to the panel and for defining a system for releasably connecting the panel to the T-grid support system 22.

While FIGS. 7-10 show the clips 52 positioned adjacent to the corner of the panel where they are to be inserted and connected, and FIGS. 3-6 show the corresponding corners with the clips connected to the panels respectively, the manner in which the clips are connected to the panel is probably best appreciated by reference to FIGS. 7-10 and 12. Looking specifically at FIG. 7, for example, in order to connect the clip to the associated corner of the panel 20, the clip is positioned so that the long leg 66 of the clip extends inwardly of and parallel with an associated one of the second opposing side edges 40*b* of the panel so as to be in confronting relationship with the vertical flange 46 thereof. The plate or hook finger 72 at the free end of the short leg 70 is aligned with the L-shaped slot 54 in the associated corner of one of the first opposing side edges 40*a* of the panel and inserted through that slot as seen, for example, in FIG. 3. Once the plate has been inserted through the slot, the long leg 66 of the clip is positioned relative to the associated end of one of the second opposing side edges 40*b* so that the trapezoidal fingers 64 on the vertical flange 46 are aligned with the bases 104 of corresponding U-shaped holes 84 so that the fingers will project through the holes when the long leg is slid into contiguous confronting relationship with the vertical flange of the second confronting side edge. With the clip 52 positioned in this manner, the spring lock finger 74 adjacent to the acutely bent free end 68 of the long leg is positioned in partially overlapping relationship with the rectangular hole 62 through the vertical leg of the second opposing side edge but by sliding the clip upwardly and to the right, as viewed in FIG. 7, while keeping the long leg compressively engaged with the vertical flange of the second opposing side edge, the lock finger will snap into the rectangular hole as seen, for example, in FIGS. 13 and 16. When the lock finger is snapped into the hole, it prevents the long leg from sliding in a reverse direction and also shifts the trapezoidal fingers within the U-shaped holes to the left so that a horizontal passage 106 through the trapezoidal fingers slidably receives a tab 108 defined within a U-shaped hole in the long leg so that the tabs cooperating with the trapezoidal fingers and the lock finger cooperating with the rectangular hole positively position the clip in the corner of the panel. As the clip is being manipulated to lock it into place, as described, the perpendicular plate 72 at the free end of the short leg 70 is merely shifted within the L-shaped slot 54 through the vertical 46 and horizontal 44 flanges of the first opposing side edge 40*a* of the panel so that it continues to project outwardly of the panel as seen, for example, in FIGS. 3-6 and 11. The lower horizontal abutment tab 102 on the plate projects into the space defined between the flat square base 38 of the panel, its vertical side wall 42 and its horizontal flange 44 to positively position the clip relative to the first opposing side edges of the panel. The notch 94 and the cam surface 88 on the plate are positioned above the horizontal flange 44 for a purpose to be described hereafter.

As the clip 52 is being positioned as described above, the J-shaped spring finger or arm 82 is slid through the vertical component of the L-shaped slot 56 in the associated second opposing side edge 40*b* of the panel so that it is positioned outwardly of the clip and outwardly of the associated vertical flange 46 and is then shifted within the larger dimension of the L-shaped slot 56 in the horizontal flange 44 so that it is held in this position not only by the interplay between the trapezoidal fingers 64 and the tabs 108 in the U-shaped holes 84, as well as the spring lock finger 74, but because of the positioning of the J-shaped finger externally of the vertical flange at a location where it cannot be displaced in an inward direction.

With the four clips 52 connected to the base panel 38 at each of its four corners, the clip is in a position to releasably connect the panel to the supporting gridwork 22 by inserting the panel upwardly into one of the openings 36 defined by the perpendicular stringers 26 of the gridwork. As mentioned previously, and as best appreciated by reference to FIG. 15, a panel 20 is inserted into an opening defined by four mutually perpendicular stringers of the T-grid support system by initially inserting a horizontal flange or shoulder 34 along one of the stringers into the notch 94 defined in the plate 72 at the end of the short leg 70 of the clip, and this is illustrated along the left edge of the panel as viewed in FIG. 15. With the horizontal flange of the T-grid support positioned within the notch, the opposite edge of the panel is raised as indicated by the arrow at the opposite end of the panel and shifted to the left as also indicated by an arrow so that as the panel is raised, the free edge of the horizontal flange or shoulder 34 of the aligned stringer in the T-grid support system will clear the latch finger 90 and will become aligned with notch 94 into which it can be positioned under spring bias. If the panel is not shifted entirely to the left, the free edge of the T-grid support will engage the cam surface 88 on the plate at the free end of the short leg of the clip and cause the short leg to flex inwardly relative to the long leg 66, which, of course, inherently occurs due to the spring steel characteristics from which the clips are made. As the plate 72 is cammed or shifted inwardly, the latch finger 90 clears the edge of the horizontal flange of the supporting T-grid member until the horizontal flange is aligned with the notch 94 in the plate whereupon the short leg springs outwardly forcing the plate outwardly so that the horizontal flange of the T-grid support is positioned within the notch of the plate at the right end of the panel similarly to the left end, as can be seen, for example, in FIG. 14.

In this manner, the first opposing side edges 40*a* of the panel 20 are snapped into position within the selected opening in the T-grid system and as this is happening, the second opposing side edges 40*b* of the panel are being raised upwardly and they are positioned on the panel so that the vertical flanges 46 slide inwardly of the adjacent horizontal flanges 34 of the T-grid system and can be raised upwardly until the horizontal flange 44 on the panel substantially abuts the underside of the adjacent horizontal flange 34 of the T-grid system. Immediately before this engagement occurs, however, the J-shaped spring arms 82 engage the underside of the horizontal flanges of the adjacent T-grid support system thereby resisting further upward movement of the panel and biasing the panel 20 downwardly along the second opposing side edges 40*b* of the panel. This bias placed upon the panel by the J-shaped spring arms also forces the horizontal flange of the T-grid system against the free end of the latch finger 90 on the plate 72 so that it is biased against the top surface of the horizontal flange of the T-grid support system.

In this manner, it will be appreciated that after the panel 20 has been fully inserted into the opening between the four mutually perpendicular stringers 26 of the supporting T-grid system 22, the panel is biased downwardly and held tightly on the horizontal flanges 34 of the supporting T-grid system to resist up and down movement. The panel is also centered horizontally between T-grid stringers adjacent to the first opposing side edges 40*a* of the panel due to the fact that the rear edge 98 of each plate 72 engages the inner surface of the adjacent vertical wall 42 of the panel while the vertical edge 92 of the plate horizontally and yieldingly engages the adjacent free edge of a horizontal flange 34 of the T-grid system to place a small shear force thereon. The spring steel from which the clip 52 is made causes the panel to seek a centered position between T-grid supports on opposite sides of the panel. A uniform vertical positioning of the panel relative to the T-grid system is obtained because the vertical distance between horizontal edge 96 of a notch 94 and the bottom of the abutment tab 102 is equivalent to the vertical distance between the bottom 38 of a panel and its horizontal flange 44 so the plate 72 fits snuggly in the panel. The bottom 38 of the panel is therefore uniformly spaced from the horizontal flange 34 of the T-grip system as the latch finger 90 on each plate rests on a horizontal flange and is uniformly spaced from the bottom of the panel 38. The panels thereby self-center themselves between these opposing T-grid support members.

Figure 15:
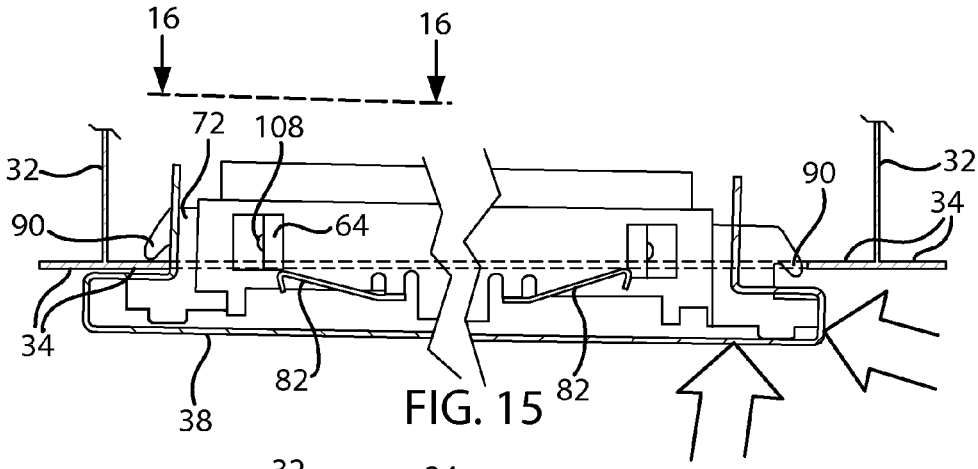
FIG. 15 is a fragmentary vertical section through the panel of FIG. 2 being inserted into an opening defined by the gridwork seen in FIG. 1.
Figure 16:
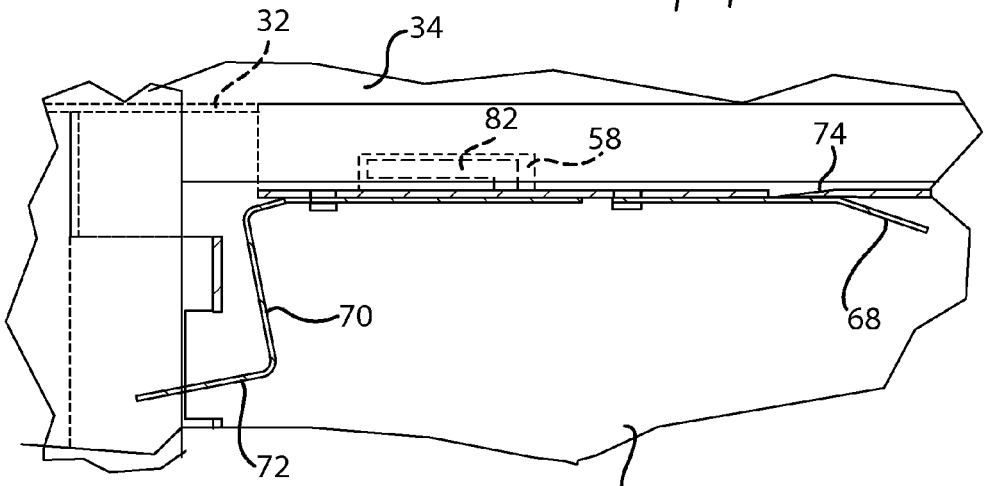
FIG. 16 is a fragmentary view taken along line 16-16 of FIG. 15.

To remove the panel 20 from the T-grid system, it is only necessary to shift one of the first opposing side edges 40*a* of the panel with an operator's finger toward the opposite first opposing side edge of the panel so that the horizontal flange 34 of the T-grid system compresses the plate 72 at the opposite end until the end that was compressed by the operator's finger clears the horizontal flange of the T-grid system and can, therefore, be pulled downwardly in a reverse of what is shown in FIG. 15 so that the panel can be easily removed from the supporting T-grid system.

It should also be appreciated with the system herein described that shear compression that might otherwise be created in the square base 38 of the panel resulting from a reactionary force on the panel through the yielding engagement of the plates 72 with the free edges of the horizontal flanges 34 of the T-grid system is transferred to the vertical flanges of the panel via the short leg 70 of the clip which is connected to the long leg 66 of the clip that extends along and is connected to the vertical flange 46 on one of the second opposing side edges 40*b*. Accordingly, the base of the panel will not buckle, bend, or otherwise be deformed. In other words, any compressive force on the panel is transferred to a vertical edge of the panel that is perpendicular to the square base of the panel so the square base will not bow or become deformed.

Pursuant to the above, it will be appreciated that a panel for use in a drop ceiling has been described which is not only self-centering but is positively retained in position under spring bias and in a manner so that the square base of the panel is not undesirably compressed and thereby possibly bowed or otherwise deformed.

Although the present invention has been described with a certain degree of particularity, it is understood the disclosure has been made by way of example, and changes in detail or structure may be made without departing from the spirit of the invention as defined in the appended claims.

What is claimed is:

1. A drop ceiling system comprising:

a suspended support system of inverted T-shaped support members interconnected to define enclosed openings therebetween, each support member having horizontal shoulders, and a plurality of panels supported on said support members, each panel of said plurality of panels positioned in one of said openings, each panel of said plurality of panels having a flat, substantially horizontal base, a peripheral side wall, horizontal flanges and vertical flanges along said side wall, and a plurality of semi-rigid resilient clips connected to said vertical flanges, said plurality of clips including fingers yieldingly engaging said shoulders on opposite sides of each panel of said plurality of panels to establish a reactionary force on each panel of said plurality of panels which is transferred by said plurality of clips to said vertical flanges of the said plurality of panels, wherein said plurality of panels are quadrangular and said plurality of clips are generally L-shaped so as to be positioned in the corners of said plurality of panels, wherein said plurality of clips include two legs which, are perpendicular to each other with one leg being to a first, vertical flange along one side of said plurality of panels and the other leg extending along a second vertical flange adjacent and perpendicular to said first vertical flange, said other leg having said finger as an element thereof with said other leg being resilient to resist inward movement of said finger relative to the second vertical flange.

2. The system of claim 1 wherein said shoulders have horizontally-extending edges and wherein said fingers yieldingly engage the horizontal edges of said shoulders.

3. The system of claim 2 wherein the reactionary force is transferred only to vertical flanges on sides of said panel adjacent to said opposite sides.

4. The system of claim 3 wherein said fingers project outwardly from said vertical flanges on said opposite sides of said panels.

5. The system of claim 1 wherein said clips are connected to said vertical flanges along sides of the panel perpendicular and adjacent to said opposite sides.

6. A drop ceiling system comprising:

a suspended support system of inverted T-shaped support members interconnected to define enclosed openings therebetween, each support member having a substantially horizontal shoulder, and a plurality of panels supported on said support members, each panel of said plurality of panels positioned in one of said openings and including:

first and second peripheral sides extending substantially perpendicular to one another, and at least one clip having:

an upwardly biased spring positioned along said first peripheral side and engaging an underside of said shoulder of one of said support members to bias a respective panel downwardly to resist upward movement of the respective panel, and an outwardly biased finger positioned along said second peripheral side and engaging said shoulder of another of said support members to bias the respective panel horizontally within said one of said openings.

7. The system of claim 6 wherein said spring is a leaf spring.

8. The system of claim 6 wherein:

said first and second peripheral sides each include a vertical flange, at least a portion of said spring is positioned outwardly of said vertical flange associated with said first peripheral side, and at least a portion of said finger is positioned outwardly of said vertical flange associated with said second peripheral side.

9. The system of claim 8 wherein:

said first and second peripheral sides each include a horizontal flange, said horizontal flange associated with said first peripheral, side at least partially defines a slot, and said spring extends through said slot.

10. The system of claim 8 wherein:

said vertical flange associated with said second peripheral side at least partially defines a slot, and said finger extends through said slot.

11. The system of claim 8 wherein said at least one clip is removably connected to the respective panel.

12. The system of claim 11 wherein said at least one clip is removably connected to said vertical flange associated with said first peripheral side of the respective panel.

13. A drop ceiling system comprising:

inverted T-shaped support members interconnected to one another to define an enclosed opening therebetween;

a panel supported on said support members and positioned in said opening, said panel having a first substantially vertical flange associated with a first side of said panel and a second substantially vertical flange associated with a second side of said panel, said first and second flanges extending substantially perpendicular to one another; and a resilient clip including a first leg and a second leg, said first leg extending along and attached to said first flange of said panel, said second leg extending away from said first leg along said second flange of said panel, a portion of said second leg resiliently engaging a substantially vertical wall of one of said support members.

14. The system of claim 13 wherein said first leg includes a spring arm that engages a substantially horizontal wall of another of said support members.

15. The system of claim 14 wherein at least a portion of said spring arm is positioned outwardly of said first flange of said panel.

16. The system of claim 15 wherein:

said one of said support members includes a substantially horizontal flange having a free edge, and said portion of said second leg engages said free edge of said substantially horizontal flange.

17. The system of claim 16 wherein said portion of said second leg includes a latch finger that engages an upper side of said substantially horizontal flange.

18. The system of claim 17 wherein said latch finger includes a cam surface angled relative to said horizontal flange.

19. The system of claim 17 wherein said portion of said second leg further includes a substantially horizontal edge that engages a lower side of said substantially horizontal flange.

20. The system of claim 19 wherein said portion of said second leg further includes a substantially vertical edge that engages said free edge of said substantially horizontal flange.

* * * * *

UNITED STATES PATENT AND TRADEMARK OFFICE

CERTIFICATE OF CORRECTION

PATENT NO. : 8,572,920 B2
APPLICATION NO. : 13/082159
DATED : November 5, 2013
INVENTOR(S) : David Bailey et al.

It is certified that error appears in the above-identified patent and that said Letters Patent is hereby corrected as shown below:

In the Claims:

1. Claim 1, Column 8, Line 5: remove "the"

2. Claim 1, Column 8, Line 10: insert --connected-- after "being"

3. Claim 1, Column 8, Line 11: remove the "," after "first"

4. Claim 16, Column 10, Line 7: correct "15" to "13"

Signed and Sealed this
Fourteenth Day of January, 2014

Michelle K. Lee

Michelle K. Lee
*Deputy Director of the United States Patent and Trademark Office*